US010403952B2

(12) United States Patent
Jessup

(10) Patent No.: US 10,403,952 B2
(45) Date of Patent: Sep. 3, 2019

(54) SURFACE WAVE LAUNCHER COMPRISING A WAVEGUIDE WITH A PLANAR CONDUCTING LAYER HAVING ONE OR MORE SLOTS DISPOSED THEREIN

(71) Applicant: Roke Manor Research Limited, Romsey Hampshire (GB)

(72) Inventor: Michael Jessup, Hampshire (GB)

(73) Assignee: Roke Manor Research Limited, Romsey Hampshire (GB)

( * ) Notice: Subject to any disclaimer, the term of this patent is extended or adjusted under 35 U.S.C. 154(b) by 53 days.

(21) Appl. No.: 15/185,090

(22) Filed: Jun. 17, 2016

(65) Prior Publication Data

US 2016/0372812 A1 Dec. 22, 2016

(30) Foreign Application Priority Data

Jun. 17, 2015 (GB) ..... 1510665

(51) Int. Cl.

| | |
|---|---|
| ***H01P 3/10*** | (2006.01) |
| ***H01P 5/08*** | (2006.01) |
| ***H01Q 13/20*** | (2006.01) |
| ***H01P 3/12*** | (2006.01) |
| ***H01Q 13/00*** | (2006.01) |

(52) U.S. Cl.

CPC ..... *H01P 3/10* (2013.01); *H01P 3/122* (2013.01); *H01P 5/08* (2013.01); *H01P 5/087* (2013.01); *H01Q 13/00* (2013.01); *H01Q 13/203* (2013.01)

(58) Field of Classification Search

CPC ..... H01P 3/10; H01Q 13/203
USPC ..... 333/240, 237
See application file for complete search history.

(56) References Cited

U.S. PATENT DOCUMENTS

| | | | | |
|---|---|---|---|---|
| 2,921,277 A * | 1/1960 | Goubau | H01P 3/10 | 333/240 |
| 2,993,205 A * | 7/1961 | Cooper | H01Q 13/28 | 333/240 |
| 3,766,378 A * | 10/1973 | Baba et al. | B61L 3/002 | 246/30 |
| 2011/0075254 A1 | 3/2011 | Cui et al. | | |
| 2016/0380327 A1* | 12/2016 | Henry et al. | H01P 1/16 | 333/237 |

FOREIGN PATENT DOCUMENTS

| | | |
|---|---|---|
| GB | 2494435 A | 3/2013 |
| GB | 2516764 A | 2/2015 |

OTHER PUBLICATIONS

Patents Act 1977: Search Report Under Section 17 in GB1510665.1 dated Jul. 18, 2015.

* cited by examiner

*Primary Examiner* — Benny Lee
(74) *Attorney, Agent, or Firm* — Banner & Witcoff, Ltd.

(57) ABSTRACT

A surface wave launcher for launching electromagnetic surface waves, the launcher comprising: a waveguide comprising a planar conductive layer; a feed structure comprising a first conductor, the first conductor coupled to the waveguide at a coupling; wherein the waveguide is arranged to be positioned adjacent to a surface suitable for guiding electromagnetic surface waves; and wherein the planar conductive layer comprises one or more slots each having a pair of longitudinal edge, the one or more slots extending through the conductive layer and arranged such that an axis radially extending from the coupling intersects each pair of longitudinal edges of the one or more slots.

19 Claims, 2 Drawing Sheets

SURFACE WAVE LAUNCHER COMPRISING A WAVEGUIDE WITH A PLANAR CONDUCTING LAYER HAVING ONE OR MORE SLOTS DISPOSED THEREIN

FIELD OF THE INVENTION

This invention relates to surface wave launchers.

BACKGROUND TO THE INVENTION

The applicant's prior published patent application GB2494435A discloses a communication system which utilises a guiding medium which is suitable for sustaining electromagnetic surface waves. The applicant's prior published application GB2516764A presents various applications and improvements to the system disclosed in GB2494435A. The contents of GB2494435A and GB2516764A are hereby incorporated by reference. The present application presents various additional improvements to the systems discloses in GB2494435A and GB2516764A.

Surface wave launchers exist that are highly efficient at propagating surface waves onto the surface of a guiding medium. Such propagation efficiency is, however, often achieved to the detriment of device compactness; highly efficient devices are often thick and cumbersome and complex to construct. Surface wave launchers having a very small footprint and thickness profile have also been made. However, such launchers suffer from low surface wave propagation efficiency.

There is therefore a need for a simplistic, compact and small footprint surface wave launcher having high wave propagation efficiency.

SUMMARY OF THE INVENTION

According to a first aspect of the invention, there is provided a surface wave launcher for launching electromagnetic surface waves, the launcher comprising: a waveguide comprising a planar conductive layer; a feed structure comprising a first conductor, the first conductor coupled to the waveguide at a coupling; wherein the waveguide is arranged to be positioned adjacent to a surface suitable for guiding electromagnetic surface waves; and wherein the planar conductive layer comprises one or more slots each having a pair of longitudinal edges, the one or more slots extending through the conductive layer and arranged such that an axis radially extending from the coupling intersects each pair of longitudinal edges of the one or more slots.

By providing slots extending through the first conductor, the inventor has found that the efficiency of propagation of surface waves transitioning from the surface wave launcher into the guiding medium, is considerably augmented. In turn, radiation loss at the edge of the first conductor as the surface waves propagate, is reduced. Thus, the efficiency of the launcher is increased to around 90%, meaning that 90% of the power entering the launcher attributes to producing surface waves on the surface of the guiding medium. The link budget is improved by around 3 dB at each end of a surface wave communication system, which reduces power requirements by 75% and similarly reduces stray radiation, thereby making a much more radiatively covert system. Furthermore, because of the simplicity of the design, the surface wave launcher can be manufactured inexpensively and quickly, for example, by using a printed circuit board (PCB).

According to a second aspect of the invention, there is provided a surface wave launcher for launching electromagnetic surface waves, the launcher comprising: a waveguide comprising a planar conductive layer and a dielectric layer, the planar conductive layer positioned on or adjacent a first surface of the dielectric layer; a feed structure comprising a first conductor, the first conductor coupled to the waveguide at a coupling; wherein the waveguide is arranged to be positioned adjacent to a surface suitable for guiding electromagnetic surface waves; and wherein the dielectric layer overlaps at least some of an edge of the first planar conductive layer.

BRIEF DESCRIPTION OF THE DRAWINGS

Embodiments of the present invention will now be described, by non-limiting example only, with reference to the accompanying drawings, in which.

DESCRIPTION OF EMBODIMENTS OF THE INVENTION

Figure 1:
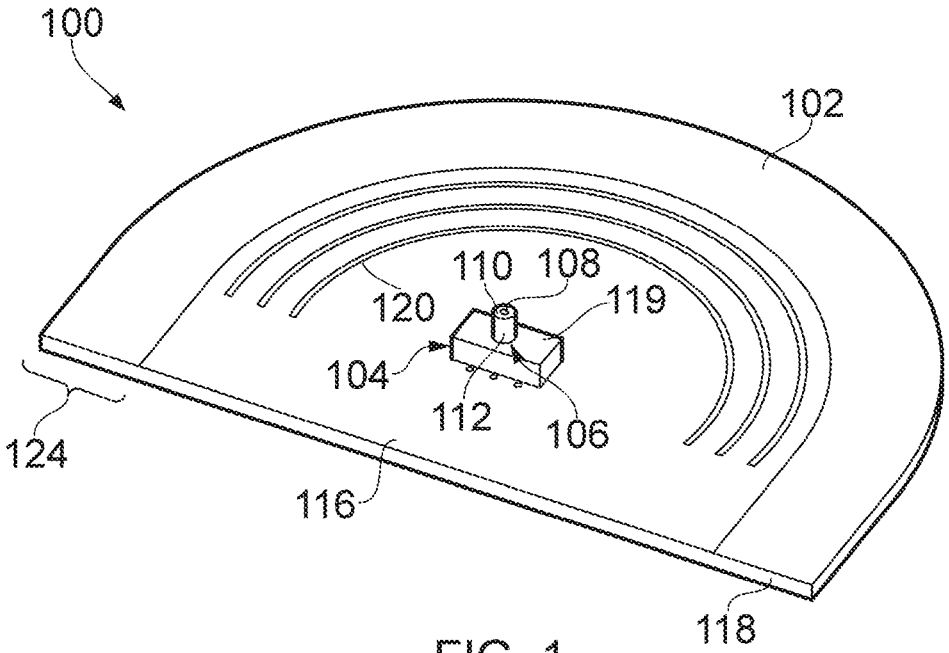
FIG. 1 is a perspective view of a surface wave launcher according to an embodiment of the present invention.
Figure 2:
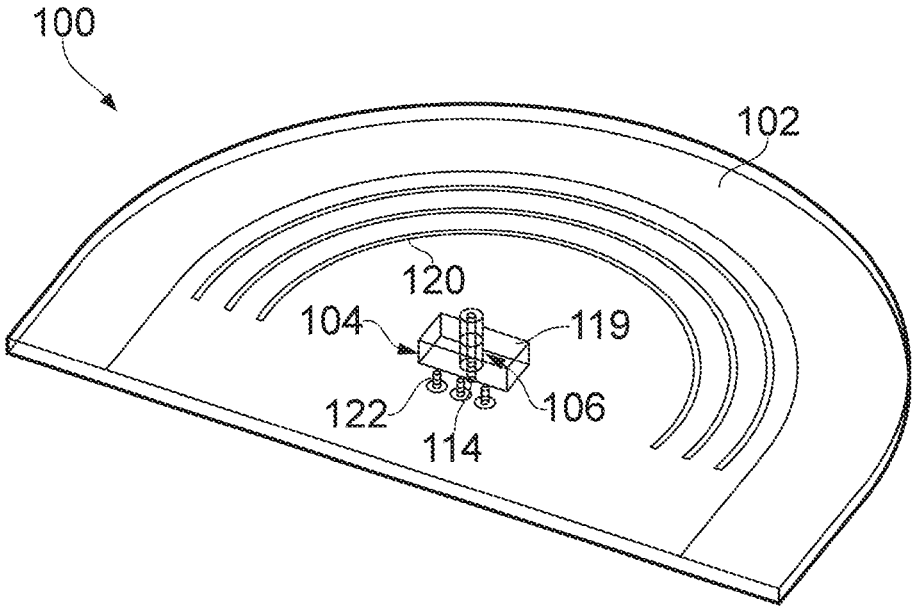
FIG. 2 is a translucent representation of the surface wave launcher of FIG. 1, showing the otherwise hidden features of a feed structure of the surface wave launcher.

FIGS. 1 and 2 show a surface wave launcher 100 in accordance with an embodiment of the present invention. The surface wave launcher 100 includes a waveguide section 102 and a feed section 104. The feed section 104 comprises a coaxial cable 106. The coaxial cable 106 includes an inner conductor 108, an insulating layer 110 and an outer conductor 112, as shown in FIG. 1. The feed section 104 also includes a feed pin 114 (FIG. 2) which is connected to the inner conductor 108 at the end of the coaxial cable 106 and couples the inner conductor 108 to the waveguide 102.

The waveguide 102 comprises a planar conductor 116 as shown in FIG. 1, which forms an upper surface of the waveguide 102. The waveguide 102 preferably also comprises a dielectric layer 118 (FIG. 1), positioned below the planar conductor 116. The dielectric making up the dielectric layer 118 is preferably low loss for the wavelength of operation, i.e. the wavelength of surface waves to be launched. The launcher 100 can use substrates having a low dielectric constant. In an example, the dielectric 118 is made from Polytetrafluoroethylene (PTFE) which has a relative permittivity of around 2.1. In an example, the dielectric layer has a thickness of between 0.1 and 0.25 times and preferably 0.18 times the operating wavelength in the dielectric.

The planar conductor 116 extends outward from the feed section 104. The feed pin 114 passes through the planar conductor 116 and dielectric layer 118 and terminates at the lower surface of the dielectric layer 118. The feed pin 114 may be terminated with a conductive disk. The conductive disk is provided to end load the feed pin 114 and improve matching of the feed to the impedance of the coaxial cable to which it may be connected (typically 50 ohms). Any suitable method may be used to end load the feed pin 114, the conductive disk being just one example. A terminal block 119 may also be provided to secure the feed section 104 to the upper surface of the planar conductor 116. The terminal block 119 can be fixed to the planar conductor 116 in any suitable manner. Where a terminal block 119 is provided, the coaxial cable 106 extends through the terminal block 119 and then through the planar conductor 116 and optional dielectric layer 118.

Figure 3:
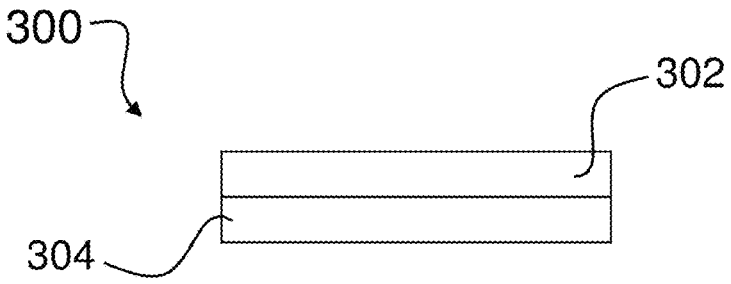
Fig. 3 (Prior Art)
FIG. 3 is a side view of a surface wave guiding medium known in the art.

In use, the lower surface of the dielectric layer 118 is positioned on the surface of a guiding medium with which the surface wave launcher 100 is arranged to operate. The guiding medium may be similar to that described in the applicant's previous published UK patent application number GB2494435. A schematic diagram of an exemplary guiding medium 300 is shown in FIG. 3. The guiding medium 300 includes a dielectric layer 302 and a conductive layer 304 positioned beneath the dielectric layer 302. Together they form a dielectric coated conductor with a reactive impedance which is higher than its resistive impedance. Such a surface is suitable for the propagation of electromagnetic surface waves.

The launcher 100 can be used to launch surface waves onto the surface of a guiding medium such as the guiding medium 300 shown in FIG. 3; the combination of the conductor 116 and the guiding medium 300 form a parallel plate waveguide. The performance of the launcher 100 at a particular wavelength can be optimised by changing the dimensions and construction of the planar conductor 116 and the dielectric layer 118.

Referring again to FIGS. 1 and 2, the planar conductor 116 is provided with one or more slots 120 extending through the entire thickness of the conductor 116. The slots are preferably arranged substantially perpendicular to one another and to an axis extending radially from the coupling between the feed section 104 and the planar conductor 116, e.g., the point at which the feed pin 114 of the coaxial cable 106 contacts the planar conductor 116. Accordingly, surface waves launched at the feed section 104 will also travel in a direction perpendicular to the longitudinal edges of the slots 120.

By providing slots 120 extending through the planar conductor 116, the inventor has found that propagation of surface waves transitioning from the surface wave launcher 100 into the guiding medium, is considerably augmented. The effect of the slots 120 may be better explained by considering the same launcher as that shown in FIGS. 1 and 2 but with no slots. As waves launched from the feed section 104 approach the edge of the planar conductor, some of the waves couple into the surface of the guiding medium while other waves diffract around the edge of the conductor 116 and are lost as radiation. The amount of energy lost as radiation due to this diffraction depends on the field gradient over the thickness of the guiding medium at the edge of the conductor 116. With the addition of the slots 120, a non-radiating field extending above planar conductor 116 is generated. This field combines with the field propagating between the planar conductor 116 and the conductive layer on the bottom of the guiding medium. The resulting field decays at a near exponential rate away from the surface of the guiding medium; conducive to the formation of surface waves and a reduction in diffraction at the edge of the conductive layer 116. In turn, radiation loss at the edge of the conductor 116 as the surface waves propagate, is reduced.

The provision of slots increases the efficiency of the launcher to around 90%, meaning that 90% of the power entering the launcher 100 via the feed section 104 attributes to producing surface waves on the surface of the guiding medium. The link budget is thereby improved by around 3 dB at each end of a surface wave communication system, reducing power requirements by 75% and similarly reducing stray radiation making a much more radiatively covert system. Additionally, because of the simplicity of the design, the conductor 116, dielectric 118 and slots 120 can be manufactured from a single printed circuit board (PCB), thus making manufacture cheap and quick and the overall thickness of the launcher very small compared with state of the art launchers having similar efficiency.

To maximise the effect of the slots 120, the slots 120 preferably have a length which exceeds the operating wavelength of the launcher 100. Ideally, the slots 120 would be as long as possible to reduce the effect of diffraction at their short edges. Additionally, experiments have shown that slots having a width which is less than 0.1 times the operating wavelength in air provide preferable results.

It has been found that increasing the number of slots 120 provided in the conductor 116 further augments the efficiency of surface wave coupling while the efficiency improvements associated with adding more than three or four slots 120 to the system are comparatively small. Where two or more slots are provided in parallel, the distance between the each slot is preferably in the region of a quarter of the operating wavelength in air. Additionally, it is preferable to have a slightly smaller spacing between the edge of the planar conductor 116 and the slot located closest to the edge of the planar conductor 116 than the spacing between the slots 120 themselves. In an example, this distance is between 0.15 and 0.25 times the operating wavelength of the launcher 100.

The distance between the feed structure and the closest slot thereto is preferably as large as possible. However, a distance of 1.5 times the operating wavelength in air has been found to provide a good compromise between launcher size and performance.

The shape and configuration of the slots may be dictated by function of the surface wave launcher. For example, in an omnidirectional launcher, slots may encircle the feed structure 104 so as to augment surface wave propagation in all directions. On the contrary, the launcher 100 shown in FIGS. 1 and 2 is directional in that surface waves propagate in a semicircle from the feed structure 104. Accordingly, the slots 120 are arranged in a semicircle around the coaxial cable 106 to augment surface waves emanating from the feed structure 104. The directional behaviour of the launcher 100 shown in FIGS. 1 and 2 is due to a plurality of conductive pins 122 (FIG. 2) provided in the proximity of the feed pin 114 which will be described in more detail below. It will be appreciated that slots may be implemented in various shapes and configurations of surface wave launchers including but not limited to those described in GB2516764A.

While in embodiments described above, the slots are arranged to be perpendicular to the direction of travel of surface waves launched from the feed section 104, in other embodiments, the slots need not be perfectly perpendicular. So long as at least a portion of the longitudinal edge of each of the slots faces the direction of travel of the surface waves, an efficiency increase will be provided.

To further augment the propagation of surface waves onto the surface of a guiding medium from the surface wave launcher 100, the dielectric layer 118 may overlap the conductive layer 116 to form a transition section 124 (FIG. 1) comprising dielectric material only and no conductor. By extending the dielectric layer 118 beyond the edge of the conductive layer 116, the surface impedance in the transition section 124 is increased making surface waves more tightly bound and thus less likely to radiate at the discontinuity formed by the edge of the planar conductor 116. It will be appreciated that there is a small discontinuity formed between the edge of the dielectric layer 118 and the surface of the guiding medium. However, the combined losses due to the radiation at each of these discontinuities is smaller than losses from the edge of the conductor 116 were the dielectric layer 118 is extended to form a transition section 124. Ideally, the transition section 124 would be as long as possible to maximise the above described effect. However, it will be appreciated that in many applications launcher size is subject to constraints. It has been found that a transition section having a width of around 0.7 to 0.8 times the wavelength of surface waves to be propagated is acceptable. Preferably, the transition section 124 extends along the entire edge of the launcher 100. However, any overlap of the dielectric layer 118 beyond the conductive layer 116 will have a positive effect on launcher efficiency. It will be appreciated that the launcher 100 including the transition section 124 may also be made from printed circuit board (PCB).

Referring again to FIGS. 1 and 2, to achieve directionality of surface wave propagation from the launcher 100, one or more axially orientated conducting pins 122 may be provided around the feed pin 114. Shown in detail in FIG. 2, three conductive pins 122 are provided in a line behind the feed pin 114. These pins 122 act as reflectors making the launcher directional. While not shown in FIG. 2, in some embodiments, the conducting pins 122 may arranged in an arc or parabola when viewed from above with the feed pin at the focus of the parabola. Thus, energy can be focused in one direction to produce a higher gain. Variations in the arc will affect both gain and the width of the beam of surface waves launched from the launcher 100. The conducting pins 122 are preferably located around 0.25 wavelengths from the feed pin 114 to maximise reflection. In some embodiments, the conducting pins 122 are separated by between 0.25 and 0.5 wavelengths of surface waves to be launched (and reflected). In parabolic embodiments, preferably more than three pins are provided and more preferably five. As with the feed pin 114, the conductive pins 122 may also be terminated at the lower surface of the dielectric layer with a conductive disk for end loading to improve their reflectivity. Again, other end loading techniques may be used.

Conductive pins (not shown) can also be added a quarter wavelength in front (i.e. in the direction of transmittal) of the feed to increase gain further. Such pins are not end loaded so that electrically they appear shorter than the feed pin 114. The underlying principle of operation of this configuration of conductive pins is analogous to that of a Yagi-Uda antenna.

Figure 4:
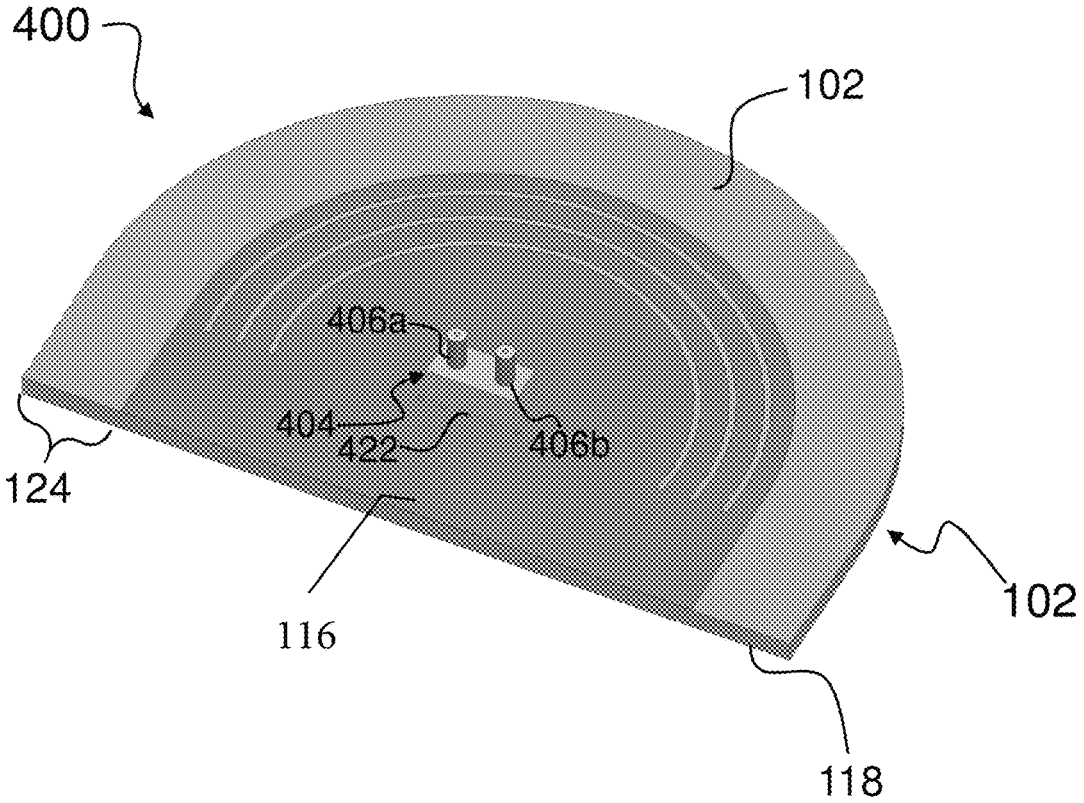
FIG. 4 is a perspective view of a surface wave launcher according to an embodiment of the present invention.

Turning now to FIG. 4, a variation of the surface wave launcher 100 of FIGS. 1 and 2 is shown, like parts having been given like numberings. The surface wave launcher 400 in FIG. 4 differs from that of FIGS. 1 and 2 in that the feed structure 404 comprises a pair of coaxial cables 406*a*, 406*b* coupled to the conductor 116. The coaxial cables 406*a*, 406*b* are similar in construction to the coaxial cable 106 of FIGS. 1 and 2. Accordingly, the feed structure 404 includes feed pins (not shown) extending through the conductor 116 and the dielectric 118 to couple inner conductors (also not shown) of the cables 406*a*, 406*b* to the conductive layer. The two feed pins may be spaced apart by approximately half a wavelength or less, for reasons explained below. The launcher 400 further comprises a plurality of conductive pins 422 extending through the dielectric layer 118 to reflect surface waves launched through each of the coaxial cables 406*a*, 406*b*. The conductive pins 422 may be arranged in any suitable manner, as explained above in relation to the conductive pins 122 of FIGS. 1 and 2.

The launcher 400 shown in FIG. 4 may be used in a surface wave monopulse radar system. A separate launcher may act to illuminate a target and the launcher 400 may receive reflected energy (or surface waves) at the two closely spaced antennas 406*a*, 406*b*. By looking at the phase of the signal received by each feed pin, it is possible to determine the bearing of a target while the timing between transmittal and receipt of surface waves determines the target's range. By spacing the feed pins apart by less than half of the operating wavelength in the dielectric layer, it is possible to locate the target at any point in the half-space in front of the antennas. It will be appreciated that the standard monopulse radar concept has been adapted in the present example for surface waves. However, it is important to note that the two feed pins are preferably provided slightly closer together than in standard monopulse radar as the wavelength of waves propagating in the dielectric is shorter than in air. Using the above described system, it is thus possible to detect the location and size of any objects or discontinuities situated on the guiding medium.

In the above-described embodiments, surface wave launchers have been described. It will be appreciate that the aforementioned surface wave launchers may operate in reverse and act as surface wave collectors. In other words, a launcher of the present invention may either act to "launch" surface waves over a suitable surface, or to "collect" surface waves from a suitable surface.

In the above described embodiments, the conductive pins may be referred to as "elements." These elements may be formed by other means, as will be appreciated by the person skilled in the art. Any method suitable for feeding a parallel plate waveguide could be used.

Features of the present invention are defined in the appended claims. While particular combinations of features have been presented in the claims, it will be appreciated that other combinations, such as those provided above, may be used.

Further modifications and variations of the aforementioned systems and methods may be implemented within the scope of the appended claims.

There follows a set of numbered features describing particular embodiments of the invention. Where a feature refers to another numbered feature then those features may be considered in combination.

Feature 1. A surface wave launcher for launching electromagnetic surface waves, the launcher comprising:

a waveguide comprising a planar conductive layer;

a feed structure comprising a first conductor, the first conductor coupled to the waveguide at a coupling;

wherein the waveguide is arranged to be positioned adjacent to a surface suitable for guiding electromagnetic surface waves; and wherein the planar conductive layer comprises one or more slots each having a pair of longitudinal edges, the one or more slots extending through the conductive layer and arranged such that an axis radially extending from the coupling intersects each pair of longitudinal edges of the one or more slots.

Feature 2. The surface wave launcher of feature 1, wherein at least one of the longitudinal edges of the one or more slots is substantially perpendicular to an axis extending radially from the coupling.

Feature 3. The surface wave launcher of features 1 or 2, wherein the one or more slots are arcuate.

Feature 4. The surface wave launcher of feature 3, wherein the one or more slots extend around the entire circumference of the coupling.

Feature 5. The surface wave launcher of any preceding feature, wherein the one or more slots comprise a plurality of slots aligned parallel to one another.

Feature 6. The surface wave launcher of any preceding feature, wherein the one or more slots have a length greater than an operating wavelength of the surface wave launcher.

Feature 7. The surface wave launcher of any preceding features, wherein the width of the one or more slots is less than 0.1 times the operating wavelength the surface wave launcher.

Feature 8. The surface wave launcher of any preceding feature, wherein the distance between the an outside longitudinal edge of a closest one of the one or more slots to the coupling is between 1 and 3 times the operating wavelength of the surface wave launcher.

Feature 9. The surface wave launcher of feature 5, wherein the distance between the plurality of slots is between 0.2 and 0.3 times the operating wavelength of the surface wave launcher and preferably 0.25 times the operating wavelength of the surface wave launcher.

Feature 10. The surface wave launcher of any preceding feature, wherein the waveguide further comprises a dielectric layer, the planar conductive layer positioned on or adjacent a first surface of the dielectric layer.

Feature 11. The surface wave launcher of feature 10, wherein the dielectric layer overlaps at least some of an edge of the first planar conductive layer, the one or more slots located between the edge and the coupling.

Feature 12. The surface wave launcher of features 10 or 11, wherein the waveguide is a printed circuit board (PCB).

Feature 13. The surface wave launcher of any of features 10 to 12, wherein the first conductor comprises a conductive feed pin extending through the planar conductive layer and the dielectric layer.

Feature 14. The surface wave launcher of feature 13, wherein an end of the feed pin extending through the planar conductive layer and the dielectric layer is end loaded.

Feature 15. The surface wave launcher of any of features 10 to 14, further comprising one or more reflecting conductive pins extending through the dielectric layer and arranged to reflect surface waves emitted from the feed pin.

Feature 16. The surface wave launcher of feature 15, wherein the one or more reflecting conductive pins are arranged in an arc around the feed pin.

Feature 17. The surface wave launcher of features 15 or 16, further comprising one or more directing conductive pins extending through the dielectric layer, the one or more directing conductive pins being electrically shorter than the first conductor and arranged to direct surface waves emitted from the feed pin.

Feature 18. The surface wave launcher of any of features 15 or 17 wherein at least one of the one or more reflective conductive pins and the one or more directing conductive pins is less than 0.3 times the operating wavelength of the surface wave launcher in the dielectric layer.

Feature 19. The surface wave launcher of any of features 16 to 18, wherein an end of the one or more reflecting conductive pins distal from the planar conductive layer is end loaded.

Feature 20. The surface wave launcher of any preceding feature, wherein the feed structure is a coaxial cable.

Feature 21. The surface wave launcher of any preceding feature, further comprising a second feed structure comprising a second conductor, the second conductor coupled to the waveguide at a second coupling.

Feature 22. The surface wave launcher of feature 21 when dependent on feature 10, wherein the distance between the coupling and the second coupling is between 0.4 and 1 times the operating wavelength of the surface wave launcher in the dielectric layer.

Feature 23. The surface wave launcher of features 10 to 22 when dependent upon feature 10, wherein the dielectric layer has a thickness of between 0.1 and 0.25 times the operating wavelength of the surface wave launcher in the dielectric layer.

Feature 24. A surface wave launcher for launching electromagnetic surface waves, the launcher comprising:

a waveguide comprising a planar conductive layer and a dielectric layer, the planar conductive layer positioned on or adjacent a first surface of the dielectric layer;

a feed structure comprising a first conductor, the first conductor coupled to the waveguide at a coupling;

wherein the waveguide is arranged to be positioned adjacent to a surface suitable for guiding electromagnetic surface waves;

wherein the planar conductive layer comprises a plurality of arcuate slots extending through the conductive layer and orientated parallel to one another, an arc of the slots extending at least partially around the coupling; and wherein the dielectric layer overlaps at least some of an edge of the first planar conductive layer.

Feature 25. A surface wave launcher for launching electromagnetic surface waves, the launcher comprising:

a waveguide comprising a planar conductive layer and a dielectric layer, the planar conductive layer positioned on or adjacent a first surface of the dielectric layer;

a feed structure comprising a first conductor, the first conductor coupled to the waveguide at a coupling;

wherein the waveguide is arranged to be positioned adjacent to a surface suitable for guiding electromagnetic surface waves; and wherein the dielectric layer overlaps at least some of an edge of the first planar conductive layer.

The invention claimed is:

1. A surface wave launcher for launching electromagnetic surface waves, the surface wave launcher comprising:

a waveguide comprising a planar conductive layer;

a feed structure comprising a first conductor, the first conductor coupled to the waveguide at a coupling;

wherein the waveguide is arranged to be positioned adjacent to a surface suitable for guiding electromagnetic surface waves; and wherein the surface wave launcher is arranged to propagate electromagnetic surface waves over the planar conductive layer;

wherein the planar conductive layer comprises one or more slots each having a pair of longitudinal edges, the one or more slots extending through the planar conductive layer and arranged such that an axis radially extending from the coupling intersects each pair of longitudinal edges of the one or more slots; and wherein the one or more slots have a length greater than an operating wavelength of the surface wave launcher.

2. The surface wave launcher as claimed in claim 1, wherein at least one of the pair of longitudinal edges of the one or more slots is substantially perpendicular to the axis radially extending from the coupling.

3. The surface wave launcher as claimed in claim 1, wherein the planar conductive layer has an arcuate edge, the one or more slots are arcuate, and wherein the one or more slots extend around a portion of a circumference of the coupling parallel to the arcuate edge of the planar conductive layer.

4. The surface wave launcher as claimed in claim 1, wherein the one or more slots comprise a plurality of slots aligned parallel to one another.

5. The surface wave launcher as claimed in claim 4, wherein a distance between the plurality of slots is between 0.2 and 0.3 times an operating wavelength of the surface wave launcher.

6. The surface wave launcher as claimed in claim 1, wherein a width of the one or more slots is less than 0.1 times an operating wavelength the surface wave launcher.

7. The surface wave launcher as claimed in claim 1, wherein a distance between an outside longitudinal edge of a closest one of the one or more slots to the coupling is between 1 and 3 times an operating wavelength of the surface wave launcher.

8. The surface wave launcher as claimed in claim 1, further comprising a second feed structure comprising a second conductor, the second conductor coupled to the waveguide at a second coupling.

9. The surface wave launcher as claimed in claim 1, wherein the waveguide further comprises a dielectric layer, the planar conductive layer positioned on or adjacent a first surface of the dielectric layer.

10. The surface wave launcher as claimed in claim 9, wherein the dielectric layer extends beyond at least some of an edge of the planar conductive layer, the one or more slots located between the edge and the coupling.

11. The surface wave launcher as claimed in claim 9, wherein the waveguide is a printed circuit board (PCB).

12. The surface wave launcher as claimed in claim 9, wherein the first conductor comprises a conductive feed pin extending through the planar conductive layer and the dielectric layer, and wherein an end of the conductive feed pin extending through the planar conductive layer and the dielectric layer is end loaded.

13. The surface wave launcher as claimed in claim 9, further comprising one or more reflecting conductive pins extending through the dielectric layer and arranged to reflect surface waves emitted from a conductive feed pin.

14. The surface wave launcher as claimed in claim 13, wherein the one or more reflecting conductive pins are arranged in an arc around the conductive feed pin, and wherein an end of the one or more reflecting conductive pins distal from the planar conductive layer is end loaded.

15. The surface wave launcher as claimed in claim 13, further comprising one or more directing conductive pins extending through the dielectric layer, the one or more directing conductive pins being electrically shorter than the first conductor and arranged to direct surface waves emitted from the conductive feed pin.

16. The surface wave launcher as claimed in claim 15 wherein the one or more reflecting conductive pins and the one or more directing conductive pins are spaced apart by less than 0.3 times an operating wavelength of the surface wave launcher in the dielectric layer.

17. The surface wave launcher as claimed in claim 1, wherein the feed structure is a coaxial cable.

18. A surface wave launcher for launching electromagnetic surface waves, the surface wave launcher comprising:

a waveguide comprising a planar conductive layer and a dielectric layer, the planar conductive layer positioned on or adjacent a first surface of the dielectric layer;

a feed structure comprising a first conductor, the first conductor coupled to the waveguide at a coupling;

wherein the waveguide is arranged to be positioned adjacent to a surface suitable for guiding electromagnetic surface waves; and wherein the dielectric layer extends radially from the coupling beyond an edge of the planar conductive layer to form a transition section between the planar conductive layer and the surface suitable for guiding electromagnetic surface waves.

19. A surface wave launcher for launching electromagnetic surface waves, the surface wave launcher comprising:

a waveguide comprising a planar conductive layer and a dielectric layer, the planar conductive layer positioned on or adjacent a first surface of the dielectric layer;

a feed structure comprising a first conductor, the first conductor coupled to the waveguide at a coupling;

wherein the waveguide is arranged to be positioned adjacent to a surface suitable for guiding electromagnetic surface waves, and wherein the surface wave launcher is arranged to propagate electromagnetic surface waves over the planar conductive layer;

wherein the planar conductive layer comprises a plurality of arcuate slots extending through the planar conductive layer and orientated parallel to one another, an arc of the plurality of arcuate slots extending at least partially around the coupling; and wherein the dielectric layer extends beyond at least some of an edge of the planar conductive layer.

* * * * *